US011414876B1

(12) United States Patent
Anderson

(10) Patent No.: US 11,414,876 B1
(45) Date of Patent: Aug. 16, 2022

(54) LEVELING SPACER FOR TILES

(71) Applicant: Stanley Anderson, Port Orange, FL (US)

(72) Inventor: Stanley Anderson, Port Orange, FL (US)

( * ) Notice: Subject to any disclaimer, the term of this patent is extended or adjusted under 35 U.S.C. 154(b) by 0 days.

(21) Appl. No.: 17/166,404

(22) Filed: Feb. 3, 2021

(51) Int. Cl.
*E04F 21/22* (2006.01)

(52) U.S. Cl.
CPC ..... *E04F 21/22* (2013.01)

(58) Field of Classification Search
CPC ..... E04F 21/22; E04F 13/0885; B44F 3/00; B28B 19/0061; B44C 3/123; B44C 3/12; B44C 1/105
USPC ..... 52/311.1–311.3, 315
See application file for complete search history.

(56) References Cited

U.S. PATENT DOCUMENTS 418,840 A * 1/1890 Hettich ..... B29C 45/14467 264/261
674,125 A * 5/1901 Semmer ..... E04F 13/0862 52/389
738,704 A * 9/1903 Semmer ..... E04F 13/0862 52/746.12
1,689,164 A * 10/1928 Sylvester ..... E04F 15/14 52/659
1,857,856 A * 5/1932 Medina ..... E04F 13/0862 156/299
2,678,896 A * 5/1954 Dratler ..... B44C 3/123 156/155
2,825,221 A * 3/1958 Brouk ..... E04F 13/0862 52/293.1
2,876,574 A * 3/1959 Powell ..... B44C 3/123 428/43
3,070,866 A * 1/1963 Kastenbein ..... E04F 13/0862 264/261
5,268,137 A * 12/1993 Scott ..... B28B 19/0061 249/112
8,539,736 B1 * 9/2013 Claramonte ..... E04F 13/0862 52/747.11
8,800,246 B2 8/2014 Gorton
10,151,118 B2 12/2018 Irvine
2006/0157634 A1 * 7/2006 Nasvik ..... B28B 7/0073 249/16
2007/0101677 A1 * 5/2007 Brailsford ..... B44C 3/123 52/747.11
2012/0058290 A1 * 3/2012 Song ..... B32B 13/04 428/49

(Continued)

FOREIGN PATENT DOCUMENTS

WO WO-2006100551 A2 * 9/2006 ..... B44C 1/28
WO WO-2009013148 A1 * 1/2009 ..... E04F 15/087

*Primary Examiner* — Babajide A Demuren
(74) *Attorney, Agent, or Firm* — Sanchelima & Associates, P.A.; Christian Sanchelima; Jesus Sanchelima

(57) ABSTRACT

A system for a leveling spacer including a spacer assembly, a tile assembly and a mosaic assembly is disclosed. The leveling spacer is used to level tiles on an uneven surface. The spacer includes cross members that define perforations therebetween. Adhesive of the tile assembly is placed on the uneven surface. The spacer is mounted onto the adhesive which seeps through the perforations. Tiles of the tile assembly are then secured onto the spacer with the adhesive that seeped through. The tiles are leveled on the spacer to a height that matches surrounding tiles. The spacer comes in various heights to allow leveling as needed.

10 Claims, 4 Drawing Sheets

(56) References Cited

U.S. PATENT DOCUMENTS

2013/0118114 A1* 5/2013 Brailsford ..... E04F 13/142
52/742.14

* cited by examiner

LEVELING SPACER FOR TILES

II. BACKGROUND OF THE INVENTION

1. Field of the Invention

The present invention relates to a leveling spacer and, more particularly, to a leveling spacer for uneven tiles.

2. Description of the Related Art

Several designs for leveling spacers have been designed in the past. None of them, however, include a perforated rectangular plastic spacer and leveling device for installing floor tiles, wherein the spacer is placed under two pieces of tile which are not the same width or located over a section of base floor which is not level and the perforations in the spacer allow for the cement or mastic product to flow into the spacer and cause it to adhere to the tile. Thereby allowing for tiles be installed flatly and leveled for proper fitting. The present invention helps to eliminate the chances of tripping on an uneven floor or the like.

Applicant believes that a related reference corresponds to U.S. Pat. No. 10,151,118 for a system and device for leveling and spacing floor tile. Applicant believes that another related reference refers to U.S. Pat. No. 8,800,246 for a device which is used to level uneven tile. None of these references, however, teach of a spacer with perforations that allow for an adhesive to flow through to attach tiles to the spacer, thereby allowing for tiles to be installed evenly leveled.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a leveling spacer that is used to evenly level uneven tiles.

It is another object of this invention to provide a leveling spacer that facilitates installing of tiles of different dimensions together and leveled.

It is still another object of the present invention to provide a leveling spacer that facilitates the installing of mosaics.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

Figure 3:
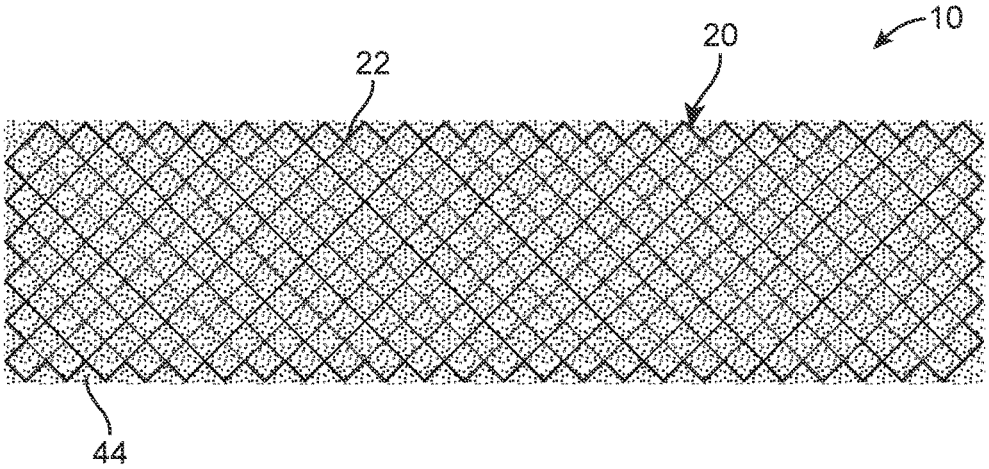

FIG. 3 represents a top view of spacer 22 with adhesive 44 seeping through perforations 28.

Figure 4:
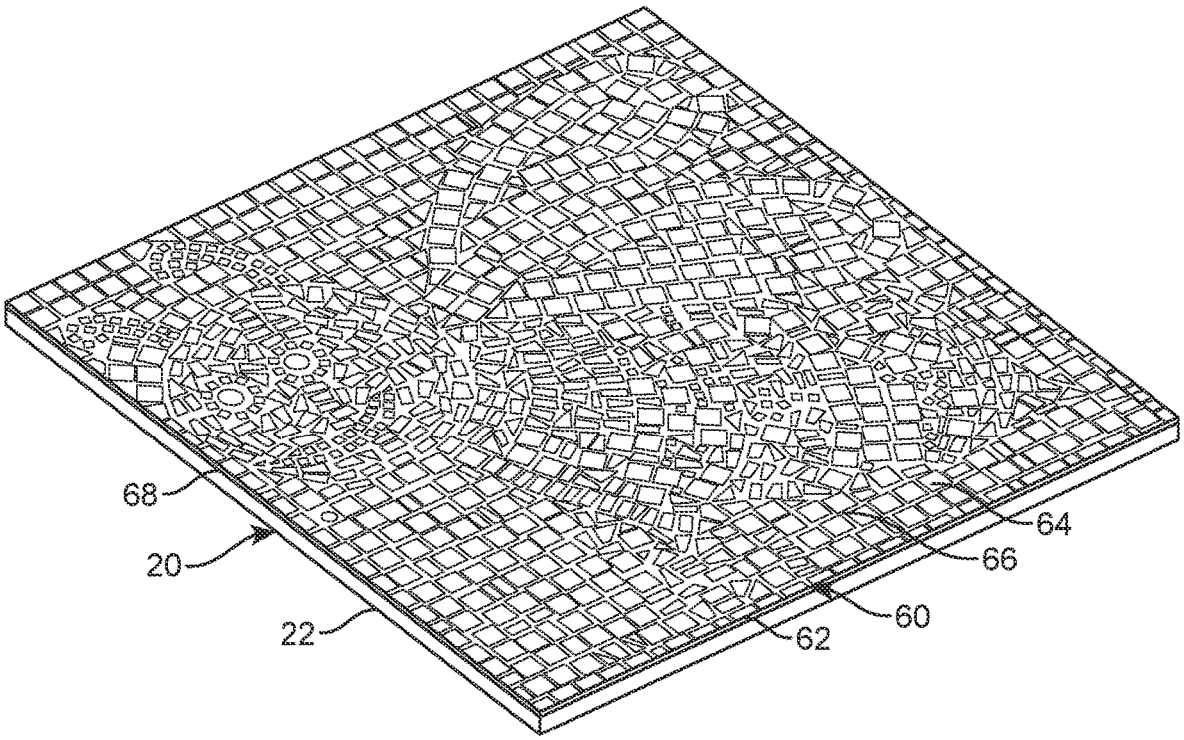

FIG. 4 illustrates mosaic 62 mounted onto spacer 22.

Figure 5:
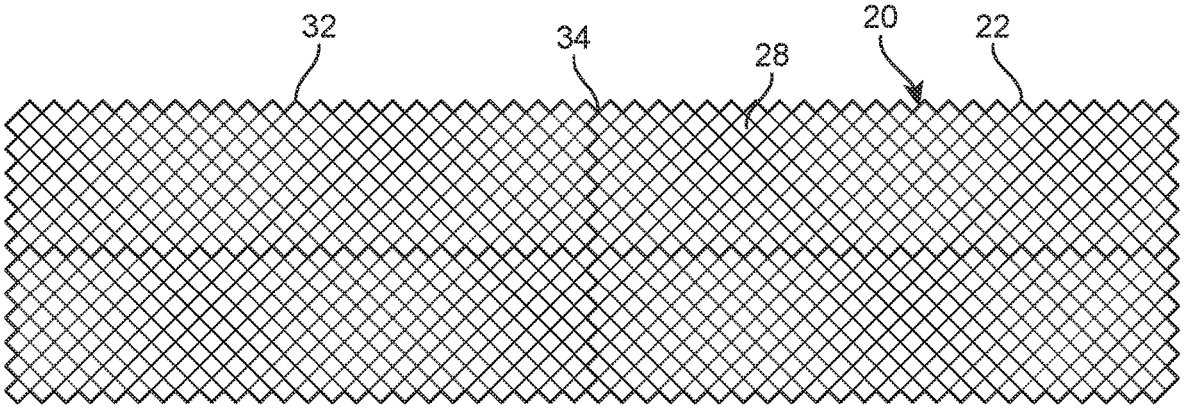

FIG. 5 represents multiple of spacer 22 secured together.

V. DETAILED DESCRIPTION OF THE EMBODIMENTS OF THE INVENTION

Referring now to the drawings, where the present invention is generally referred to with numeral 10, it can be observed that it basically includes a spacer assembly 20, a tile assembly 40 and a mosaic assembly 60.

Figure 1:
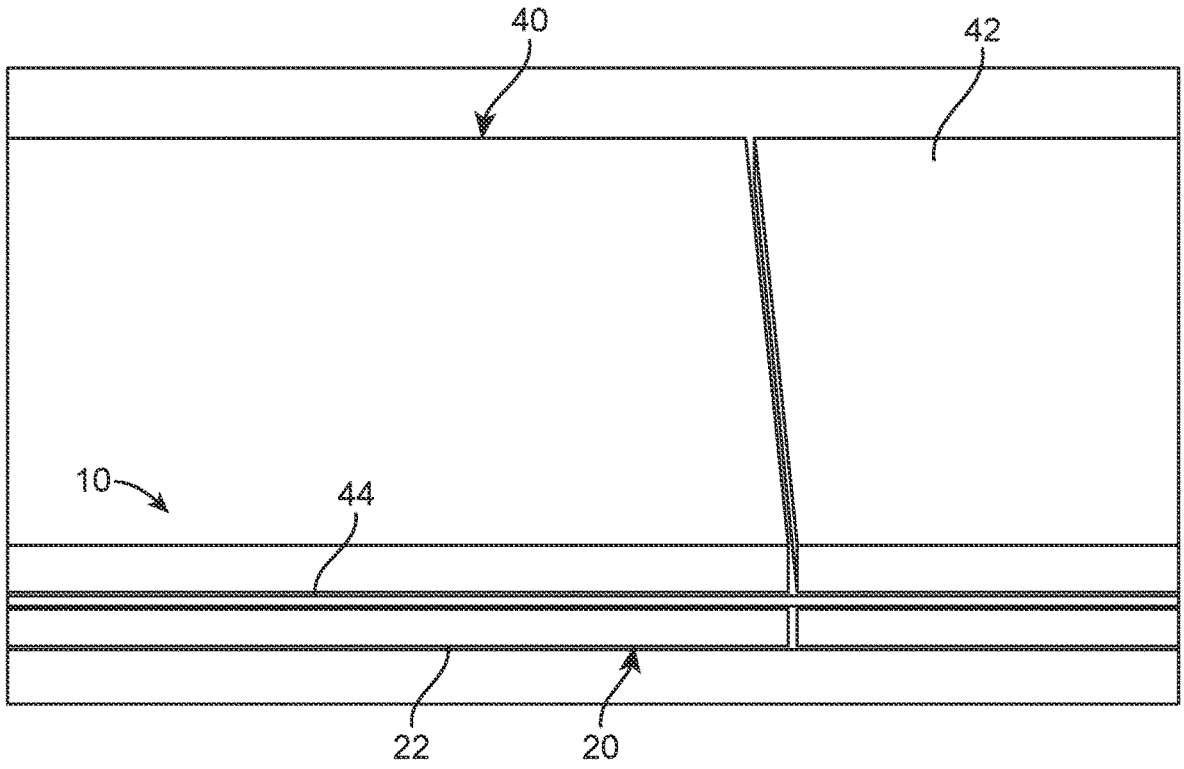
FIG. 1 represents an operational view showing spacer 22 used to level uneven tiles 42.

As best shown in FIG. 1, it can be seen how a leveling spacer 10 is used to level a surface, such as a floor or a wall. Spacer assembly 20 may be used during the installation of tile assembly 40. Spacer assembly 20 may be secured underneath of tile assembly 40. Tiles 42 of tile assembly 40 may be uneven if the surface being installed on is uneven. This is unsafe as the uneven tiles 42 may cause a person to trip, fall and potentially get injured. Further, uneven tiles 42 are unappealing and make the installation of tiles 42 appear unappealing and sloppy.

Figure 2:
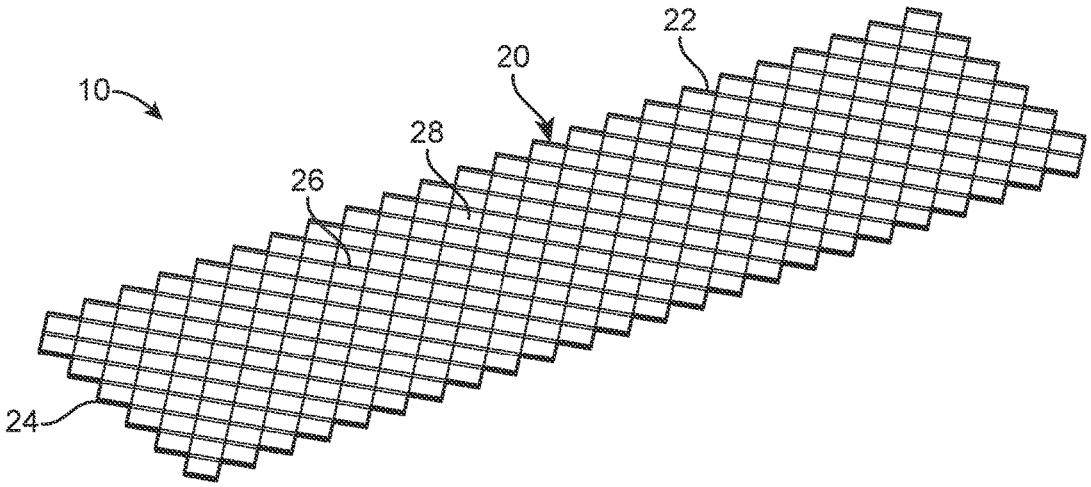
FIG. 2 shows an isometric view of spacer 22 in one embodiment.
Figure 2A:
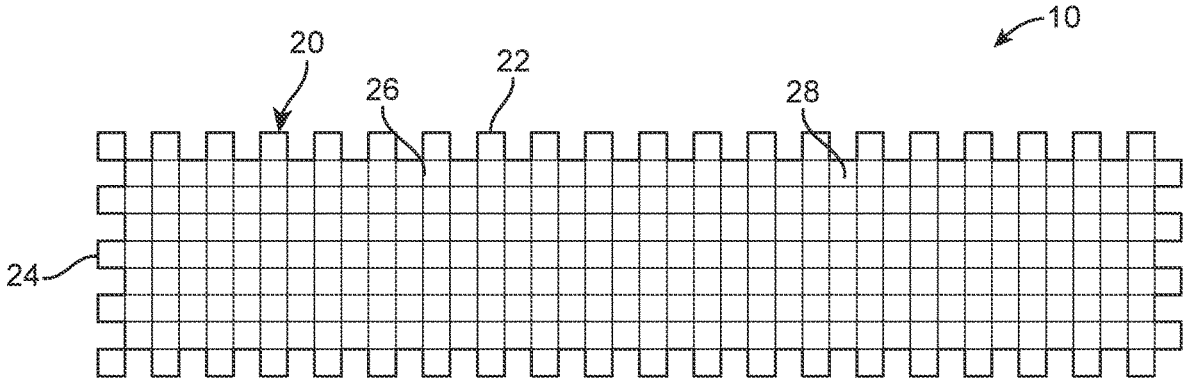
FIG. 2A shows a top view of an alternate embodiment of spacer 22.

As best seen in FIG. 2, spacer assembly 20 may include a spacer 22. Spacer 22 may be rectangular, in one embodiment. However, it is to be understand that spacer 22 may be of a predetermined shape as per the needs of the user. Spacer 22 may be made of materials such as plastic, rubber, wood or the like. In an alternate embodiment, multiple of spacer 22 may be secured together on a sheet 32, preferably with connectors 34. The user may selectively detach the needed of spacer 22 from sheet 32 by detaching connectors 34 that unite multiple of spacer 22 together. Multiple of spacer 22 may be secured adjacently to each other on the sheet with fasteners. It is to be understood that spacer 22 may have a predetermined height to allow leveling to occur as needed for different heights. Alternatively, it may be possible to adjust the height needed for leveling of tiles 42 by stacking multiple of spacer 22 together until the desired height is reached.

Spacer 22 may include a reinforced perimeter 24. Reinforced perimeter 24 may help spacer 22 to remain rigid and durable. Reinforced perimeter 24 may also help spacer 22 from collapsing under too much weight from tiles 42 and users walking thereon. Reinforced perimeter 24 may be in a crenellation configuration with alternating patterns about the entire perimeter of spacer 22. The crenellation configuration of reinforced perimeter 24 may be in a triangular pattern or square pattern, preferably.

It can be best seen in FIG. 2, that entirely within reinforced perimeter 24 may be cross members 26. Cross members 26 may extend diagonally across spacer 22. Cross members 26 may intersect within reinforced perimeter 24. It is to be understood that cross members 26 also help to provide rigidness to spacer 22. Importantly, perforations 28 may be defined between cross members 26. Perforations 28 may be of different shapes and dimensions. It is to be understood that, preferably, perforations 28 in abutting contact with reinforced perimeter 24 may be triangular in shape.

Tile assembly 40 may further include an adhesive 44, as best seen in FIG. 3. Adhesive 44 may be used to secure spacer 22 and tiles 42 together. Adhesive 44 may be placed on an uneven surface, such as the floor or wall. Spacer 22 may then be placed atop of adhesive 44. Adhesive 44 will secure spacer 22 to the uneven surface. Additionally, some of adhesive 44 may seep through perforations 28. Adhesive 44 which has seeped through perforations 28 may then be used to secure tiles 42 atop of spacer 22. It is to be understood that spacer 28 may be of an adequate height which would allow for tiles 42 to be leveled to a height that cooperates with surrounding of tiles 42 already secured on the desired surface, as best seen in FIG. 1. Resulting in a leveled floor that is appealing and safe to walk thereon.

In an alternate embodiment, a mosaic assembly 60 may be secured onto spacer 22, as best seen in FIG. 4. Mosaic assembly 60 may include mosaic 62. Mosaic 62 may be used as an art display. Mosaic 62 may allow users to express their creative ideas. Mosaic 62 may include mosaic tiles 64 that create a design 66. Spacer 22 may be secured to a desired surface with a mosaic adhesive 68. Mosaic 62 may then be created by using mosaic adhesive 68 which has seeped through perforations 29 to secure mosaic tiles 64 onto spacer 22. Mosaic tiles 64 may be arranged such that the desired of design 66 is created on spacer 22. Design 66 may then be displayed as desired. It may be suitable for mosaic tiles 64 to be arranged on multiple of spacer 22 to have design 66 expand across multiple of spacer 22, in an alternate embodiment.

Leveling spacer 10 may help to level uneven surfaces for a more appealing surface. When a ground surface is leveled then safety may increase as chances of people tripping on the ground surface may become reduced. Tiles 42 may be secured onto spacer 22 to become leveled with surrounding of tiles 42. Additionally, leveling spacer 10 may facilitate and expedite the installing of mosaic 62.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a leveling spacer, comprising:

a. a spacer assembly including a spacer, cross members, and a reinforced perimeter, said spacer having perforations, said spacer has a preconfigured height, said preconfigured height makes the spacer a volumetric spacer, said spacer is capable of being coupled with other spacers as if each spacer were a module, said perforations are configured to permit the pass of a material therethrough, said spacer is configured to be placed on top of uneven surfaces and receive tiles on top, said perforations have rhombus shapes, each of said perforations are arranged to be coplanar and adjacent to each other about lateral edges of each rhombus, said reinforced perimeter provide rigidness to said spacer, said reinforced perimeter conforms a boundary of said spacer, said cross members extend diagonally across said spacer, said cross members delimit the perforations;

b. a tile assembly including tiles and an adhesive; and c. said adhesive is configured to be spread on an uneven surface, said adhesive then receives said spacer, a force is applied on top of said spacer in order to level said spacer, when said force is applied the adhesive then seeps through said perforations, said perforations do not receive the tiles therein, instead said tiles are then mounted on top of said spacer, said tiles are then secured together using the excess of adhesive that seeped through said perforations, said spacer leveling said tiles to a height that matches surrounding of said tiles on said surface, thereby allowing said tiles to be leveled with surrounding of said tiles on said surface which is uneven.

2. The system of claim 1, wherein said reinforced perimeter is in a crenellation configuration.

3. The system of claim 2, wherein said crenellation configuration is in an alternating square pattern or an alternating triangular pattern.

4. The system of claim 1, wherein said spacer includes cross members that intersect.

5. The system of claim 4, wherein said cross members extend diagonally across said spacer.

6. The system of claim 4, wherein said perforations are defined between said cross members.

7. The system of claim 1, wherein said perforations are of different shapes.

8. The system of claim 1, wherein multiple of said spacer are secured together and adjacently on a sheet with connectors.

9. The system of claim 1, wherein said perforations in abutting contact with said reinforced perimeter are triangular.

10. A system for a leveling spacer, consisting of:

a. a spacer assembly including a spacer, cross members, and a reinforced perimeter, said spacer having perforations, said spacer has a preconfigured height, said preconfigured height makes the spacer a volumetric spacer, said spacer is capable of being coupled with other spacers as if each spacer were a module, said spacer is made of plastic, said perforations are configured to permit the pass of a material therethrough, said spacer is configured to be placed on top of uneven surfaces and receive tiles on top, said perforations have rhombus shapes, each of said perforations are arranged to be coplanar and adjacent to each other about lateral edges of each perforation, said cross members extend diagonally across said spacer, said cross members delimit the perforations, said reinforced perimeter provide rigidness to said spacer, said reinforced perimeter conforms a boundary of said spacer;

b. a tile assembly including tiles and an adhesive; and c. said adhesive is configured to be spread on an uneven surface, said adhesive then receives said spacer, a force is applied on top of said spacer in order to level said spacer, when said force is applied the adhesive then seeps through said perforations, said perforations do not receive the tiles therein, instead said tiles are then mounted on top of said spacer, said tiles are then secured together using the excess of adhesive that seeped through said perforations, said spacer leveling said tiles to a height that matches surrounding of said tiles on said surface, thereby allowing said tiles to be leveled with surrounding of said tiles on said surface which is uneven.

* * * * *